US008354578B2

(12) United States Patent
Decker

(10) Patent No.: US 8,354,578 B2
(45) Date of Patent: Jan. 15, 2013

(54) INTONATED NUT WITH LOCKING MECHANISM FOR MUSICAL INSTRUMENTS AND METHODS OF USE

(76) Inventor: Gregory Scott Decker, Denver, CO (US)

( * ) Notice: Subject to any disclaimer, the term of this patent is extended or adjusted under 35 U.S.C. 154(b) by 0 days.

(21) Appl. No.: 13/416,466

(22) Filed: Mar. 9, 2012

(65) Prior Publication Data

US 2012/0160076 A1 Jun. 28, 2012

Related U.S. Application Data

(63) Continuation of application No. 12/789,130, filed on May 27, 2010, now Pat. No. 8,153,873, which is a continuation-in-part of application No. 12/231,287, filed on Sep. 2, 2008, now Pat. No. 7,750,217.

(51) Int. Cl.
*G10D 3/06* (2006.01)

(52) U.S. Cl. ..... 84/314 N

(58) Field of Classification Search ..... 84/314 N
See application file for complete search history.

(56) References Cited

U.S. PATENT DOCUMENTS

| | | | | |
|---|---|---|---|---|
| 2,959,085 | A | 11/1960 | Porter | |
| 3,599,524 | A | 8/1971 | Jones | |
| 3,748,945 | A | 7/1973 | Kramer | |
| 3,936,048 | A | 2/1976 | Dunlap | |
| 4,295,404 | A | 10/1981 | Smith | |
| 4,475,432 | A | 10/1984 | Stroh | |
| 4,517,874 | A | 5/1985 | Fender | |
| D280,330 | S | 8/1985 | Tanaka | |
| 4,574,678 | A | 3/1986 | Edwards | |
| 4,667,561 | A | 5/1987 | Storey | |
| 4,669,350 | A | 6/1987 | Gressett | |
| 4,682,610 | A | 7/1987 | Freelain | |
| RE32,863 | E | 2/1989 | Edwards | |
| 4,985,055 | A | 1/1991 | Thorne | |
| 5,481,956 | A | 1/1996 | LoJacono et al. | |
| 5,750,910 | A | 5/1998 | LoJacono | |
| 5,932,822 | A | 8/1999 | Bernstein | |
| 6,156,962 | A | 12/2000 | Poort | |
| 6,220,311 | B1 | 4/2001 | Litto | |
| 6,433,264 | B1 | 8/2002 | Gimpel | |
| 6,508,163 | B1 | 1/2003 | Weatherill | |
| 6,637,321 | B2 | 10/2003 | Wang | |
| 6,700,043 | B2 | 3/2004 | Hirayama | |
| 6,706,957 | B1 | 3/2004 | Merkel | |
| 7,351,895 | B1 * | 4/2008 | LeBlanc | 84/298 |
| 7,378,582 | B2 | 5/2008 | Kinoshita | |
| 7,543,978 | B2 | 6/2009 | Clement | |
| 7,750,217 | B2 * | 7/2010 | Decker | 84/314 N |
| 8,153,873 | B2 * | 4/2012 | Decker | 84/314 N |
| 2002/0078815 | A1 * | 6/2002 | Lojacono | 84/314 N |
| 2010/0236376 | A1 * | 9/2010 | Decker | 84/314 N |
| 2012/0160076 | A1 * | 6/2012 | Decker | 84/314 N |

* cited by examiner

*Primary Examiner* — David Warren
*Assistant Examiner* — Robert W Horn
(74) *Attorney, Agent, or Firm* — Terrence M. Wyles, Esq.

(57) ABSTRACT

The present invention provides in combination, an intonated string nut and string-locking mechanism for a musical string instrument with a fingerboard where the combination intonated string nut and string-locking mechanism includes a string-nut fulcrum and a string-locking means, where each string-nut fulcrum may have a varying linear position in relation to each individual string in order to provide the optimum compensation amount for improving the consistency and production of in-tune musical notes during play for musical string instruments with fingerboards. Also disclosed are methods of use of various embodiments for the intonated string nut and string-locking mechanism.

20 Claims, 4 Drawing Sheets

INTONATED NUT WITH LOCKING MECHANISM FOR MUSICAL INSTRUMENTS AND METHODS OF USE

CROSS-REFERENCE TO RELATED APPLICATIONS

This patent application claims the benefit of and is a Continuation of U.S. patent application Ser. No. 12/789,130, filed on May 27, 2010, which is a Continuation-in-Part of, and also claims the benefit of, U.S. patent application Ser. No. 12/231,287 (now U.S. Pat. No. 7,750,217), filed on Sep. 2, 2008.

Both U.S. patent application Ser. No. 12/789,130 and U.S. patent application Ser. No. 12/231,287 (now U.S. Pat. No. 7,750,217) are hereby incorporated by reference for all purposes.

BACKGROUND OF THE INVENTION

1. Field of the Invention

This invention relates to musical string instruments with fretted fingerboards, and more specifically to an improved nut mechanism that incorporates a string length intonation adjustment means and a means for rigidly securing the strings in position in order to ensure tuning stability.

2. Existing Art

It is well known in the art that stringed musical instruments with fretted fingerboards require specific string length and string height adjustments at the bridge and at the nut fulcrum points in order for the instrument to play in tune, and also be comfortable to play. String intonation is the technique wherein the theoretical length of a string is elongated in order to compensate for the increase in pitch that naturally occurs due to an increase in a string's tension as it is deflected away from its resting position and towards the fingerboard for contact. This "compensation" allows the musical notes produced by varying a string's vibrating length at specific frets along the fingerboard to be in tune relative to each other.

Throughout most of the history of fretted string instrument manufacture, this compensation was only done at the bridge fulcrum point. During the final adjustment phase of instrument production, a luthier would pluck the string, and at a point located precisely half way between the nut and the bridge, the luthier would then lightly touch the string thereby producing the first harmonic of the open string, with that note being an octave above pitch of the open string. The luthier would then deflect the string to the twelfth fret, located precisely at one half of the string's theoretical length, and pluck it in order to produce the fretted octave note of the open string. He would then compare these harmonic octave notes and fretted octave notes repeatedly while adjusting the position of the string's bridge fulcrum point away from the nut until the harmonic and fretted notes of the string being adjusted were identical.

Unfortunately, this technique only works in regards to fretted notes. When one compares the relationship between an instrument's fretted notes, and its open string notes wherein a string is simply plucked and allowed to vibrate between its bridge and nut fulcrum points, the ideal theoretical relationship between open string frequencies and fretted string frequencies does not exist. This is because vibrating open strings are not deflected towards the fingerboard, and therefore they do not require any compensation. The open string notes will therefore be lower in frequency in relationship to the fretted notes than they should be. With this, if a player tunes his instrument to its open string notes, the only fretted note that will be in ideal relative tune with the open string's pitch will be the fretted note produced at the twelfth fret. The fretted notes above the twelfth fret will go progressively flat as you move towards the bridge, and the fretted notes below the twelfth fret will go progressively sharp as you move towards the nut. A means must be used to restore the ideal relationship between open string and fretted note frequencies.

In an attempt to correct this difficulty and allow both open stings notes and fretted notes to be in relative tune with each other, the idea of additionally compensating a string's length at the nut in order to restore the ideal ratio between open string and fretted note frequencies has found its way into the art. Non-adjustable examples of this concept can be found in U.S. Pat. No. 4,295,404, U.S. Pat. No. 6,156,962, and U.S. Pat. No. 6,433,264. An adjustable example of a compensated string nut can be found in U.S. Pat. No. 5,750,910.

Another notable and recent attempt to deal with these tuning issues is disclosed in U.S. Pat. No. 7,378,582 to Kinoshita (Kinoshita). Kinoshita discloses a uniform projection that spans across the entire front of the string nut assembly. While the Kinoshita projection may or may not improve the intonation features of the musical instrument, it fails to provide each string-nut fulcrum with a varying linear position in relation to each individual string. In other words, Kinoshita merely applies the same linear position to each instrument string, treating all the strings uniformly and thus fails to ensure the ideal tuning of each string.

Furthermore, additional difficulties in keeping the instrument in proper tune arise with the usage of vibrato mechanisms. These mechanisms allow the player to vary the tension of the strings during play in order to produce a wide range of frequency related effects, most notably vibrato, which is a periodic change in a string's frequency. These mechanisms are difficult to use in that the return of a string to its original tension is very difficult to achieve because these mechanisms typically use springs for their restoring force. Changes in temperature, friction of a string's contact points at the bridge and nut, the stability of a string's material, and variations in the holding position of a string's tuning mechanism as a string's tension changes during vibrato mechanism usage all combine to make the tuning and stability of string tensions during play very difficult to achieve.

There are a variety of mechanisms within the art that provide the player with a means for eliminating string slippage at the nut in order to improve the tuning stability of the instrument. With each mechanism, the player rigidly secures a length of each string between two flat surfaces. U.S. Pat. No. 4,517,874, U.S. Pat. No. Des. 280,330, and U.S. Pat. No. 4,475,432 show string-locking mechanisms that require the usage of an allen wrench to secure the string between two flat surfaces. U.S. Pat. No. 4,574,678, U.S. Pat. No. 4,667,561, U.S. Pat. No. 4,669,350, U.S. Pat. No. 5,932,822, and U.S. Pat. No. Re. 32,863 each illustrate string-locking mechanisms that can be engaged manually by the player without the need for using a tool. Any of these locking mechanisms can be used with the present invention.

DETAILED DESCRIPTION

Overview

Figure 1:
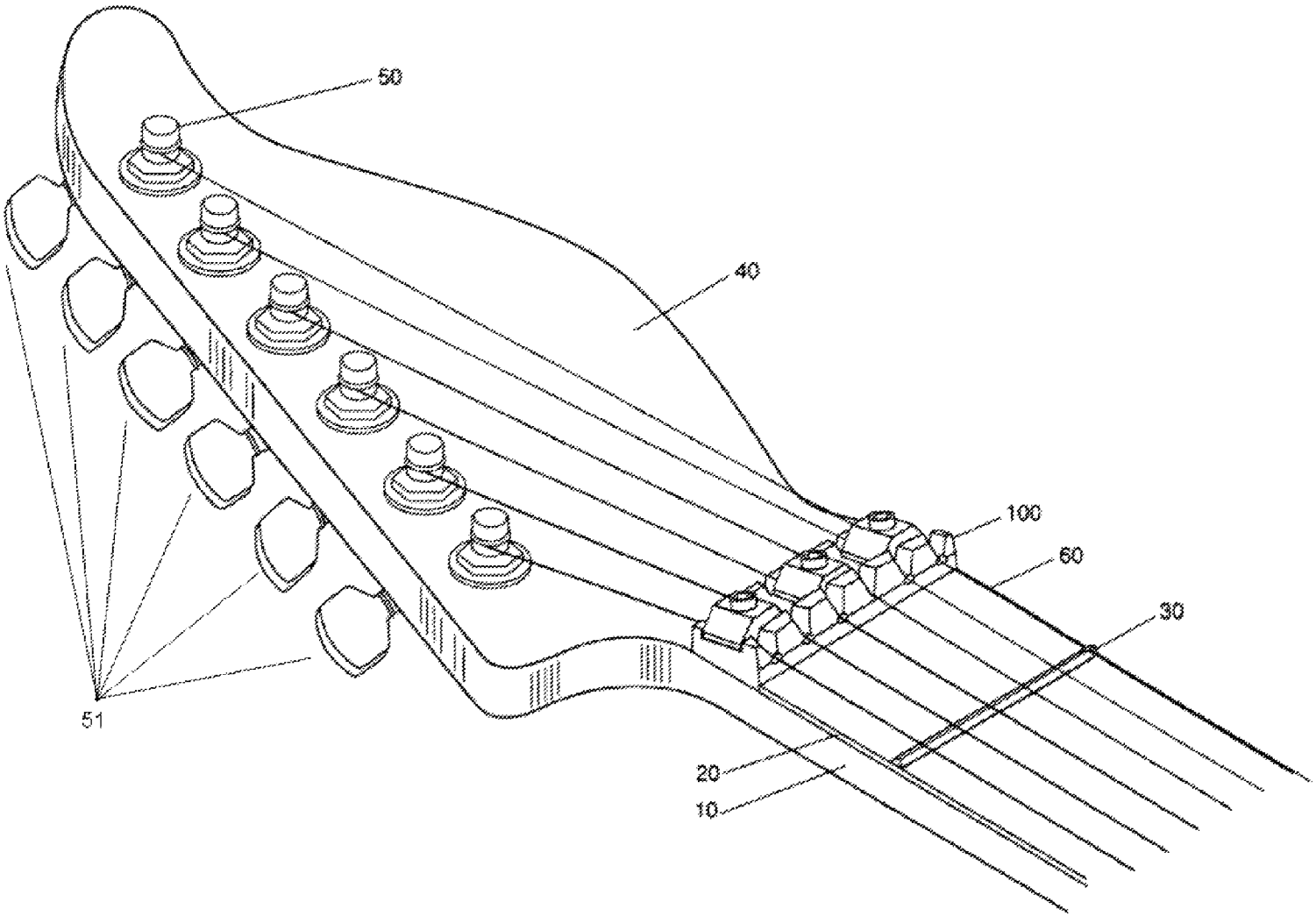
FIG. 1 depicts a perspective view of one embodiment of the intonated nut with locking mechanism.

Musical note production during play and the art of musical string instrument design find advancement with the mechanical format of the various embodiments of the present invention. The various embodiments of the present inventive disclosure provide a player of a stringed musical instrument with a combination intonated string nut and string-locking mechanism as a means for providing for the production of musical notes that are more precisely in-tune during play, and also provide for a more exacting return of string tensions to their proper levels after the usage of a vibrato mechanism for frequency related effects has been engaged.

Terminology

The terms and phrases as indicated in quotes (" ") in this section are intended to have the meaning ascribed to them in this Terminology section applied to them throughout this document, including the claims, unless clearly indicated otherwise in context. Further, as applicable, the stated definitions are to apply, regardless of the word or phrase's case, to the singular and plural variations of the defined word or phrase.

The term "or", as used in this specification and the appended claims, is not meant to be exclusive; rather, the term is inclusive, meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of the phrase "in one embodiment" and/or "in one variation" in various places in the specification are not necessarily all meant to refer to the same embodiment.

Directional and/or relational terms such as, but not limited to, left, right, nadir, apex, top, bottom, vertical, horizontal, back, front, and lateral are relative to each other, are dependent on the specific orientation of an applicable element or article, are used accordingly to aid in the description of the various embodiments, and are not necessarily intended to be construed as limiting.

As applicable, the terms "about" and "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

The term "fret" means a raised portion on the neck of a stringed musical instrument that extends generally across the width of the neck. Frets divide the neck into fixed segments at intervals related to a musical framework. Typically, on western instruments, each fret represents one semitone, where one octave is divided into twelve semitones.

A "fretted" stringed musical instrument, as used herein unless otherwise indicated means any stringed musical instrument that has at least one fret disposed on its neck. This also includes so-called semi-fretted musical instruments, such as, for example only, the Malagasy kabosy and the Afghan Rubab. Also included in this definition are stringed musical instruments that have retractable frets, a scallaoped fretboard, or slanted frets.

A "nonfretted" stringed musical instrument, as used herein unless otherwise indicated means any stringed instrument that has no provisions for having at least one fret on its neck. Examples include, but are not limited to, violins, violas, cellos, and bass violins.

First Embodiment

An Intonated String Nut with Locking Mechanism

This embodiment is directed to an intonated nut with a locking mechanism that can be used with a stringed musical instrument. Referring now to the drawings, FIG. 1 illustrates a partial view of a guitar's neck 10, fingerboard 20, frets 30, headstock 40, machine heads 50, strings 60, and the combination intonated string nut and string-locking mechanism of the present embodiment 100.

Figure 2:
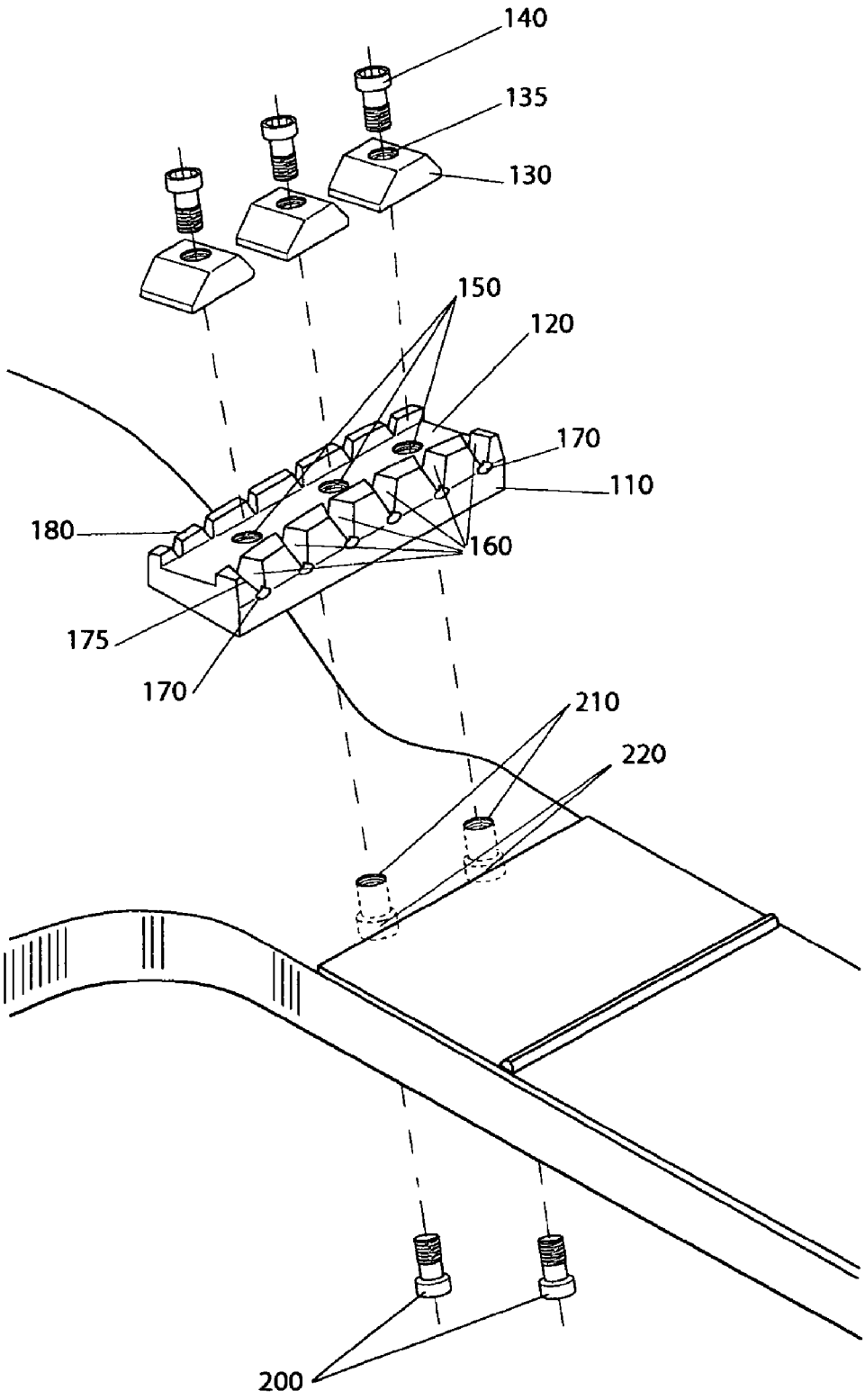
FIG. 2 depicts an exploded perspective view of one embodiment of the intonated nut with locking mechanism.

FIG. 2 illustrates a perspective exploded view of the preferred embodiment of the present device 100. As can be seen, the present device 100 includes base plate 110, string-locking plate channel 120, string-locking plates 130 that include string-locking-plate slip fit through holes 135, string-locking-plate bolts 140, string-locking-plate threaded holes 150, front elongated v-shaped string guides 160, string intonation cutouts 170 with intonated string-nut fulcrums 175, and rear elongated v-shaped string guides 180, string-nut-securing thread holes 190, and string-nut-securing bolts 200. Through-neck, counter-bored, slip-fit holes 210 with boss' 220 within neck 10 is a common feature used by guitar manufacturers.

By placing the present device 100 in position above through-neck counter-bored slip-fit holes 210 wherein string-nut-securing thread holes 190 are in alignment with said through-neck slip-fit counter-bored holes 210, and then by placing string-nut-securing bolts 200 within said through-neck slip-fit counter-bored holes 210, and rotating said string-nut-securing bolts 200 until they engage with and are rigidly torqued against the threads of string-nut-securing thread holes 190 and boss 220 of said through-neck counter-bored slip-fit holes 210, the present device 100 finds rigid position securement on the instrument at the proper location between fingerboard 20 and headstock 40 on neck 10.

Front elongated v-shaped string guides 160, intonation cutouts 170 with intonated string-nut fulcrums 175, and rear elongated v-shaped string guides 180 provide the means for guiding and positioning the strings 60 in the proper location while also providing the means for supplying the additional compensated string length required for the open string notes and the fretted string notes to stay in relative tune with each other during play. The elongated v-shape of each front elongated v-shaped string guide 160 and rear elongated v-shaped string guide 180 helps to aid in the initial attachment and final positioning of the string. The side of each string guide provides a surface for the string to follow to its final position located in the bottom center where the intonated string-nut fulcrums 175 are located.

Figure 3:
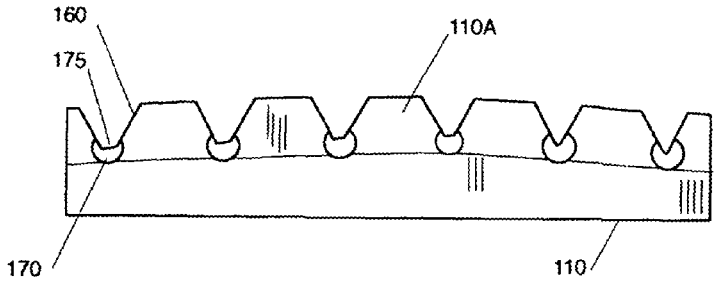
FIG. 3 depicts a front view of the main plate view of one embodiment of the intonated nut with locking mechanism.

FIG. 3 shows a front view of base plate 110. As can be seen, front elongated v-shaped string guides 160, string intonation cutouts 170, and the fronts of the intonated string-nut fulcrums 175 are shown. In the manufacturing process, a small endmill was used to fabricate the string intonation cutouts 170, and the depth of each of the intonated string-nut fulcrums 175 in a single plunging operation. The circular shape of each of the string intonation cutouts 170 was found to be very beneficial in that a minimum of material needed be removed, and it provides for a smooth top edge of the front of base plate 110 thereby eliminating any potential for accidental damage to the player's hand.

Figure 4:
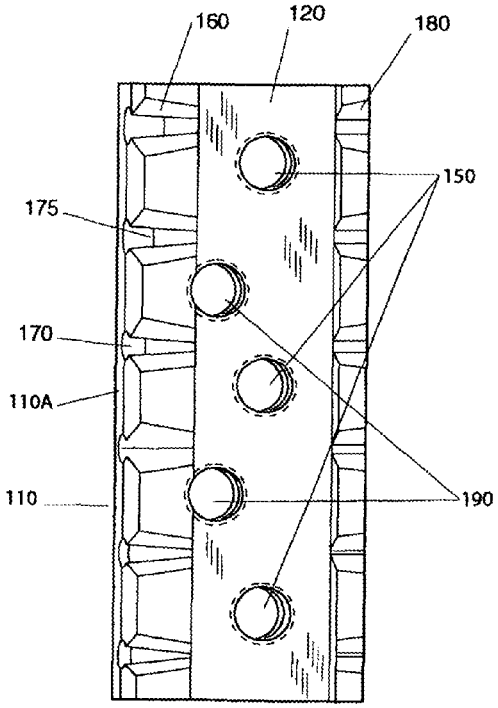
FIG. 4 depicts a top view of the main plate view of one embodiment of the intonated nut with locking mechanism.

A top view of base plate 110 is shown in FIG. 4. This figure clearly shows the varying depths of each of the string intonation cutouts 170 relative to the front face 110*a*, and therefore the varying linear position of each string's intonated string-nut fulcrum 175, thereby providing for the desired amount of compensation for each string. As can be appreciated, the ideal compensated length amount for each string will vary with the overall scale length of the instrument, and with the diameter and type of strings chosen by the player. String-locking-plate channel 120, string-locking-plate thread holes 150, rear elongated v-shaped string guides 180, and string-nut-securing thread holes 190 are also shown.

Figure 5:
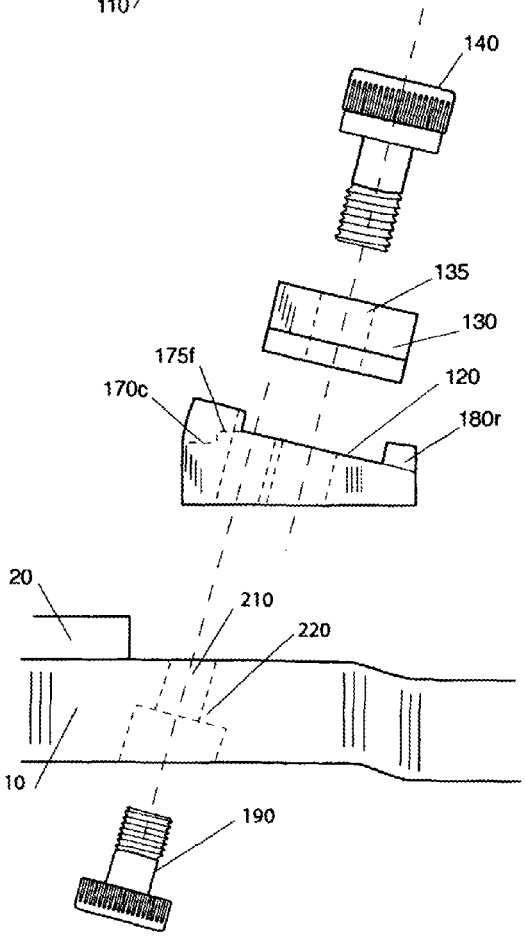
FIG. 5 depicts an exploded side view of the main plate view of one embodiment of the intonated nut with locking mechanism.

In FIG. 5, an exploded side view of the present device is shown. Dashed lines 170*c* and 175*f* illustrate the configuration of string intonation cutouts 170, and intonated string-nut fulcrums 175. Dashed line 180*r* illustrates the bottom face of rear elongated v-shaped string guide 180. By slipping string-locking-plate bolt 140 through string-locking-plate slip fit through hole 135 of string-locking-plate 130, aligning it with string-locking-plate threaded hole 150 and rotating it until the bottom surface of the head of string-locking-plate bolt 140 is in contact with the top of string-locking-plate 130 and the threads of string-locking-plate bolts 140 are securely torqued against the complementary mating threads of string-locking-plate threaded holes 150 by means of a wrench, each string will be compressed and rigidly held in position between the fixed surface at the bottom of s string-locking-plate channel 120 and the bottom face of string lock 130, thereby providing for an improvement in string tension stability especially when used in combination with a vibrato mechanism. Common vibrato mechanisms comprise a lockable floating vibrato bridge and arm assembly, similar to those discussed in U.S. Pat. No. 4,638,711 to Stroh and in U.S. Pat. No. 5,311,804 to Wilkinson, for example.

Figure 6:
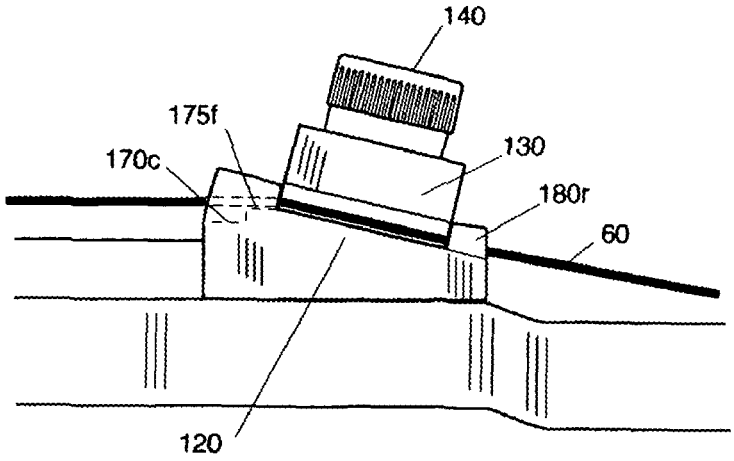
FIG. 6 depicts an assembled side view of one embodiment of the intonated nut with locking mechanism.

FIG. 6 illustrates an assembled side view of the present device. As can be seen by the dashed line 170*c*, string intonation cutout 170 provides relief below string 60, and the bottom of string 60 is in contact with intonated string-nut fulcrum illustrated by dashed line 175*f*. It can also be seen that the depth of string intonation cutout 170 determines the linear position of the front of intonated string-nut fulcrum 175, and therefore the amount of intonation provided to each string 60. The locking feature of the present device is also clearly indicated. As is seen, a portion of each string 60 is rigidly compressed between the bottom of string-locking-plate channel 120 and the bottom of string-locking plate 130.

Figure 7:
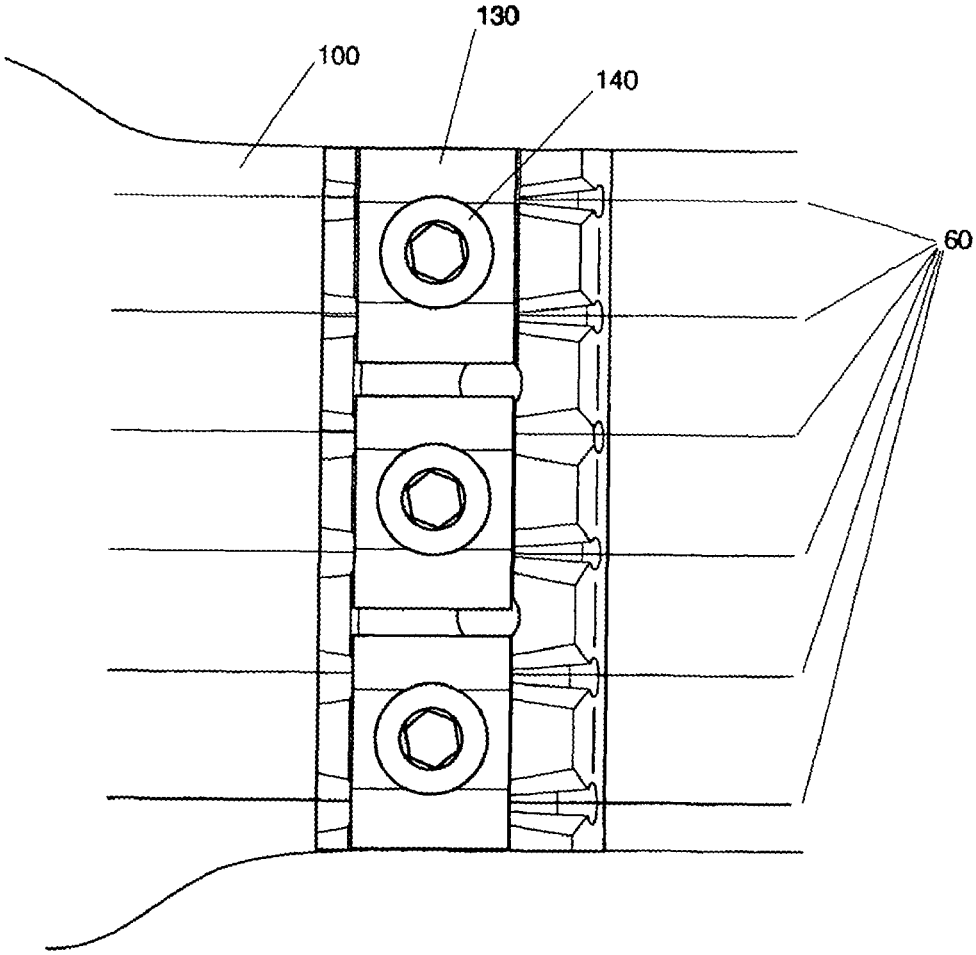
FIG. 7 depicts an assembled top view of one embodiment of the intonated nut with locking mechanism.

A top view of the present device fully assembled is seen in FIG. 7. As is clearly seen, each string is provided a specific amount of compensation, and each is rigidly locked into linear position by means of compressing each string between a fixed surface and a variable height surface.

Second Embodiment

An Intonated String Nut with Locking Mechanism

This embodiment is directed to a combination of an intonated nut and associated locking mechanism that can be used with a stringed musical instrument with a fretted fingerboard. Refer to FIGS. 1-7. The device comprises a string-nut fulcrum for each individual string, and a string-locking means 130 to secure each string 60. Each string-nut fulcrum 175 has a varying linear position in relation to each said individual string, whereby the varying linear position provides the optimum compensation amount for each individual string 60, when each individual string 60 is caused to vibrate between a bridge fulcrum and the string-nut fulcrum 175. The string-locking means 120, 130, 140 provides rigid linear position securability of each of the individual strings 60 at each of the string-nut fulcrums 175 by means of compressing each of the strings between a first rigid surface 120 with a fixed position and a second rigid surface 130 that is height-adjustable and that is position lockable. As a result of this optimum compensation, the musical notes produced will be in tune relative to each other when each individual string is caused to vibrate between the bridge fulcrum and any one of a plurality of fret fulcrums.

In variations of this embodiment, the string-nut fulcrum 175 is positioned at a varying depth relative to a front face 110A of the combination intonated string nut and string-locking mechanism 100 in order to provide the ideal amount of linear compensation for each of the instrument strings 60.

This embodiment can be enhanced by further including a string-positioning mechanism 160, 170, 175, 180 for each of the strings 60.

This embodiment can be enhanced wherein each string-positioning mechanism 160, 170, 175, 180 further comprises a first v-shaped string-guidance channel 160 located at a front face of the combination intonated string nut and string-locking mechanism 100, and a second v-shaped string-guidance channel 180 located at a rear face of the combination intonated string nut and string-locking mechanism 100. In some variations of this embodiment, the first v-shaped string-guidance channel 160 and the second v-shaped string-guidance channel 180 are separated by a distance.

This embodiment can be further enhanced wherein the first rigid surface 120 with a fixed position is located between the first v-shaped string-guidance channel 160 and the second v-shaped string-guidance channel 180.

This embodiment can be further enhanced wherein the second rigid surface 130 is a bottom surface of a height-adjustable, position-securable, rigid, plate-like means. In some variations of this embodiment, the height-adjustable, position-securable, rigid, plate-like means includes a through hole 150. In other variations, the height-adjustable, position-securable, rigid, plate-like means 130 slip-fits between the first v-shaped string-guidance channel 160 and the second v-shaped string-guidance channel 180, and above the first rigid surface 120. In still more variations, the height-adjustable and position-securable rigid plate-like means 130 provides position securability for one or more of the instrument strings 60.

This embodiment can be enhanced by wherein the base of the device further includes one or more thread holes 150. In a variation of this enhancement, the position height adjustability and said position securability is achieved by means of a threaded bolt 140 used in combination with the through hole 150, one of the aforementioned one or more thread holes 150, and a torquing tool.

Third Embodiment

A Method of Making an Intonated String Nut with Locking Mechanism

This embodiment is directed to a method for making a combination of an intonated nut and associated locking mechanism that can be used with a stringed musical instrument with a fretted fingerboard. Refer to FIGS. 1-7. The method comprises the steps of providing a string-nut fulcrum for each individual string, and providing a string-locking means 130 to secure each string 60. Each string-nut fulcrum 175 has a varying linear position in relation to each said individual string, whereby the varying linear position provides the optimum compensation amount for each individual string 60, when each individual string 60 is caused to vibrate between a bridge fulcrum and the string-nut fulcrum 175. The string-locking means 120, 130, 140 provides rigid linear position securability of each of the individual strings 60 at each of the string-nut fulcrums 175 by means of compressing each of the strings between a first rigid surface 120 with a fixed position and a second rigid surface 130 that is height-adjustable and that is position lockable. As a result of this optimum compensation, the musical notes produced will be in tune relative to each other when each individual string is caused to vibrate between the bridge fulcrum and any one of a plurality of fret fulcrums.

In variations of this embodiment, the string-nut fulcrum 175 is positioned at a varying depth relative to a front face 110A of the combination intonated string nut and string-locking mechanism 100 in order to provide the ideal amount of linear compensation for each of the instrument strings 60.

This embodiment can be enhanced by further comprising the step of, during the step of providing the string-nut fulcrum 175 for each individual string 60, fabricating a string-intonation cutout for 170 each string-nut fulcrum 175 to form intonated string-nut fulcrums 175, whereby each string-nut fulcrum 175 is positioned at said depth relative to a front face 110A of the combination intonated string nut and string-locking mechanism 100 in order to provide the ideal amount of linear compensation for each of the instrument strings 60. Moreover, in a variation of this enhancement the cutout is substantially circular in shape, whereby as a result the top edge of the front base of the combination intonated string nut and string-locking mechanism 100 remains substantially smooth.

This embodiment can be enhanced by further comprising the step of providing a string-positioning mechanism 160, 170, 175, 180 for each of the strings 60.

This embodiment can be enhanced by further comprising the step of providing each string-positioning mechanism 160, 170, 175, 180 a first v-shaped string-guidance channel 160 located at a front face of the combination intonated string nut and string-locking mechanism 100, and a second v-shaped string-guidance channel 180 located at a rear face of the combination intonated string nut and string-locking mechanism 100. In some variations of this embodiment, the first v-shaped string-guidance channel 160 and the second v-shaped string-guidance channel 180 are separated by a distance.

This embodiment can be further enhanced wherein the first rigid surface 120 with a fixed position is located between the first v-shaped string-guidance channel 160 and the second v-shaped string-guidance channel 180.

This embodiment can be further enhanced wherein the second rigid surface 130 is a bottom surface of a height-adjustable, position-securable, rigid, plate-like means. In some variations of this embodiment, the height-adjustable, position-securable, rigid, plate-like means includes a through hole 150. In other variations, the height-adjustable, position-securable, rigid, plate-like means 130 slip-fits between the first v-shaped string-guidance channel 160 and the second v-shaped string-guidance channel 180, and above the first rigid surface 120. In still more variations, the height-adjustable and position-securable rigid plate-like means 130 provides position securability for one or more of the instrument strings 60.

This embodiment can be enhanced by further comprising the step of providing one or more thread holes 150 in the base of the device 100 In a variation of this enhancement, the position height adjustability and said position securability is achieved by means of a threaded bolt 140 used in combination with the through hole 150, one of the aforementioned one or more thread holes 150, and a torquing tool.

Fourth Embodiment

A Method of Using an Intonated String Nut with Locking Mechanism

This embodiment is directed to a method for using a combination of an intonated nut and associated locking mechanism, according to the First and/or second Embodiments described supra, that can be used with a stringed musical instrument with a fretted fingerboard. Refer to FIGS. 1-7. The method comprises the steps of

- Ensuring that the combination intonated string nut and string-locking mechanism 100 is installed on the neck 10 of a target stringed and fretted musical instrument;
- Ensuring that each string 60 of the musical instrument is suspended at one end at the upper neck 10 of the musical instrument by its associated string-nut fulcrum 175, which has been positioned at a predetermined depth 170 in order to provide the ideal amount of linear compensation for the associated string;
- Adjusting each string tension by its associated tuner 51 on the headstock 40 of the musical instrument;
- Ensuring that each string 60 is locked into a rigid linear position by the string-locking means 120, 130, 140; and
- Playing the musical instrument by causing at least one string 60 on the musical instrument to vibrate.

In variations of this embodiment, the string-nut fulcrum 175 is positioned at a varying depth relative to a front face 110A of the combination intonated string nut and string-locking mechanism 100 in order to provide the ideal amount of linear compensation for each of the instrument strings 60.

This embodiment can be enhanced by further including a string-positioning mechanism 160, 170, 175, 180 for each of the strings 60.

This embodiment can be enhanced wherein each string-positioning mechanism 160, 170, 175, 180 further comprises a first v-shaped string-guidance channel 160 located at a front face of the combination intonated string nut and string-locking mechanism 100, and a second v-shaped string-guidance channel 180 located at a rear face of the combination intonated string nut and string-locking mechanism 100. In some variations of this embodiment, the first v-shaped string-guidance channel 160 and the second v-shaped string-guidance channel 180 are separated by a distance.

This embodiment can be further enhanced wherein the first rigid surface 120 with a fixed position is located between the first v-shaped string-guidance channel 160 and the second v-shaped string-guidance channel 180.

This embodiment can be further enhanced wherein the second rigid surface 130 is a bottom surface of a height-adjustable, position-securable, rigid, plate-like means. In some variations of this embodiment, the height-adjustable, position-securable, rigid, plate-like means includes a through hole 150. In other variations, the height-adjustable, position-securable, rigid, plate-like means 130 slip-fits between the first v-shaped string-guidance channel 160 and the second v-shaped string-guidance channel 180, and above the first rigid surface 120. In still more variations, the height-adjustable and position-securable rigid plate-like means 130 provides position securability for one or more of the instrument strings 60.

This embodiment can be enhanced by wherein the base of the device further includes one or more thread holes 150. In a variation of this enhancement, the position height adjustability and said position securability is achieved by means of a threaded bolt 140 used in combination with the through hole 150, one of the aforementioned one or more thread holes 150, and a torquing tool.

This embodiment can be enhanced wherein the target stringed and fretted musical instrument is a type played by plucking the strings of the musical instrument. Variations of this enhancement include using a target stringed and fretted musical instrument selected from any of the following families of stringed instruments: guitar, mandolin, banjo, lute, and zither.

This embodiment can be enhanced wherein the target stringed and fretted musical instrument has a vibrato mechanism, and wherein the method further comprises the step of employing the vibrato mechanism to cause periodic variances in the pitch of one or more vibrating strings.

Fifth Embodiment

A Method of Using an Intonated String Nut with Locking Mechanism

This embodiment is directed to a method for using a combination of an intonated nut and associated locking mechanism, according to the First and/or second Embodiments described supra, that is adapted to be used with a stringed musical instrument with a non-fretted fingerboard. Refer to FIGS. 1-7. The method comprises the steps of

- Ensuring that the combination intonated string nut and string-locking mechanism 100 is installed on the neck 10 of a target stringed and fretted musical instrument;
- Ensuring that each string 60 of the musical instrument is suspended at one end at the upper neck 10 of the musical instrument by its associated string-nut fulcrum 175, which has been positioned at a predetermined depth 170 in order to provide the ideal amount of linear compensation for the associated string;
- As necessary, adjusting each string tension by its associated tuner 51 on the headstock 40 of the musical instrument;
- Ensuring that each string 60 is locked into a rigid linear position by the string-locking means 120, 130, 140; and
- Playing the musical instrument by causing at least one string 60 on the musical instrument to vibrate.

In variations of this embodiment, the string-nut fulcrum 175 is positioned at a varying depth relative to a front face 110A of the combination intonated string nut and string-locking mechanism 100 in order to provide the ideal amount of linear compensation for each of the instrument strings 60.

This embodiment can be enhanced by further including a string-positioning mechanism 160, 170, 175, 180 for each of the strings 60.

This embodiment can be enhanced wherein each string-positioning mechanism 160, 170, 175, 180 further comprises a first v-shaped string-guidance channel 160 located at a front face of the combination intonated string nut and string-locking mechanism 100, and a second v-shaped string-guidance channel 180 located at a rear face of the combination intonated string nut and string-locking mechanism 100. In some variations of this embodiment, the first v-shaped string-guidance channel 160 and the second v-shaped string-guidance channel 180 are separated by a distance.

This embodiment can be further enhanced wherein the first rigid surface 120 with a fixed position is located between the first v-shaped string-guidance channel 160 and the second v-shaped string-guidance channel 180.

This embodiment can be further enhanced wherein the second rigid surface 130 is a bottom surface of a height-adjustable, position-securable, rigid, plate-like means. In some variations of this embodiment, the height-adjustable, position-securable, rigid, plate-like means includes a through hole 150. In other variations, the height-adjustable, position-securable, rigid, plate-like means 130 slip-fits between the first v-shaped string-guidance channel 160 and the second v-shaped string-guidance channel 180, and above the first rigid surface 120. In still more variations, the height-adjustable and position-securable rigid plate-like means 130 provides position securability for one or more of the instrument strings 60.

This embodiment can be enhanced by wherein the base of the device further includes one or more thread holes 150. In a variation of this enhancement, the position height adjustability and said position securability is achieved by means of a threaded bolt 140 used in combination with the through hole 150, one of the aforementioned one or more thread holes 150, and a torquing tool.

This embodiment can be enhanced wherein the target stringed musical instrument is a type played with a bow. Variations of this enhancement include using a target stringed musical instrument selected from any of the following stringed instruments: violin, viola, cello, and double bass. Similar types of bow-played stringed instruments are also contemplated as being included in this embodiment; e.g., any instrument in the violin or viol families.

This embodiment can be enhanced wherein the target stringed musical instrument is a type played by striking one or more strings on the musical instrument. Variations of this enhancement include using a target stringed musical instrument selected from any of the following stringed instruments: hammer dulcimer and clavichord, or any comparable instrument.

Alternative Embodiments and Other Variations

The various embodiments and variations thereof described herein and/or illustrated in the accompanying Figures are merely exemplary and are not meant to limit the scope of the inventive disclosure. It should be appreciated that numerous variations of the invention have been contemplated as would be obvious to one of ordinary skill in the art with the benefit of this disclosure.

For example, while the exemplary embodiments have been directed in large part to fretted stringed musical instruments, one ordinarily skilled in the art will immediately appreciate that the intonated nut with locking mechanism described herein can easily be applied to a wide variety of stringed musical instruments, including non-fretted musical instruments, such as a violin, viola, cello, or bass violin.

Hence, those ordinarily skilled in the art will have no difficulty devising myriad obvious variations and improvements to the invention, all of which are intended to be encompassed within the scope of the claims which follow.

What is claimed is:

1. In combination, an intonated string nut and string locking mechanism for a musical string instrument with a fretted fingerboard wherein said combination intonated string nut and string locking mechanism includes:

a string nut fulcrum for each individual string, wherein each said string nut fulcrum has a varying linear position in relation to each said individual string in order to optimize the compensation amount for the musical notes produced for each said individual string, when each said individual string is caused to vibrate between a bridge fulcrum and said string nut fulcrum, and whereby as a result of said optimum compensation, the musical notes produced will be in tune relative to each other when each said individual string is caused to vibrate between said bridge fulcrum and any one of a plurality of fret fulcrums; and a string locking means, wherein said string locking means provides a rigid linear position securability of each of said individual strings at each of said string nut fulcrums by means of compressing each of said strings between a first rigid surface with a fixed position and a second rigid surface that is height adjustable and position lockable.

2. The combination intonated string nut and string locking mechanism of claim 1, further including a string positioning mechanism for each of said strings.

3. The combination intonated string nut string locking mechanism of claim 2, wherein each said string nut fulcrum is positioned at a varying depth relative to a front face of said combination intonated string nut and string locking mechanism in order to provide the ideal amount of linear compensation for each of said strings.

4. The combination intonated string nut and string locking mechanism of claim 2, wherein each said string positioning mechanism includes:

a first v-shaped string guidance channel located at a front face of said combination intonated string nut and string locking mechanism; and a second v-shaped string guidance channel located at a rear face of said combination intonated string nut and string locking mechanism.

5. The combination intonated string nut and string locking mechanism claim 4, wherein said first v-shaped string guidance channel and said second v-shaped string guidance channel are separated by a distance.

6. The combination intonated string nut and string locking mechanism of claim 4, wherein said first rigid surface with a fixed position is located between said first v-shaped string guidance channel and said second v-shaped string guidance channel.

7. The combination intonated string nut and string locking mechanism of claim 4, wherein said second rigid surface is a bottom surface of a height-adjustable and position-securable rigid plate-like means.

8. The combination intonated string nut and string locking mechanism of claim 7, wherein the height-adjustable and position-securable rigid plate-like means includes a through hole.

9. The combination intonated string nut and string locking mechanism of claim 8, wherein said height-adjustable and position-securable rigid plate-like means slip-fits between said first v-shaped string guidance channel and said second v-shaped guidance channel, and above said first rigid surface.

10. The combination intonated string nut and string locking mechanism of claim 7, wherein the height-adjustable and position-securable rigid plate-like means provides position securability for one or more of said strings.

11. The combination intonated string nut and string locking mechanism of claim 1, wherein a base of said combination intonated string nut and string locking mechanism includes one or more thread holes.

12. The combination intonated string nut and string locking mechanism of claim 8, wherein:

a base of said combination intonated string nut and string locking mechanism includes one or more thread holes, and said position height adjustability and said position securability is achieved by means of a threaded bolt used in combination with said through hole, one of said one or more thread holes, and a torquing tool.

13. A method of making a combination intonated string nut and string locking mechanism for a musical string instrument with a fretted fingerboard, comprising the steps of:

providing a string nut fulcrum for each individual string, wherein each said string nut fulcrum has a varying linear position in relation to each said individual string in order to optimize the compensation amount for the musical notes produced for each said individual string, when each said individual string is caused to vibrate between a bridge fulcrum and said string nut fulcrum, and whereby as a result of said optimum compensation, the musical notes produced will be in tune relative to each other when each said individual string is caused to vibrate between said bridge fulcrum and any one of a plurality of fret fulcrums; and providing a string locking means, wherein said string locking means provides a rigid linear position securability of each of said individual strings at each of said string nut fulcrums by means of compressing each of said strings between a first rigid surface with a fixed position and a second rigid surface that is height adjustable and position lockable.

14. The method of claim 13, wherein further comprising the step of providing a string positioning mechanism for each of said strings.

15. The method of claim 14, wherein each said string nut fulcrum is positioned at a varying depth relative to a front face of said combination intonated string nut and string locking mechanism in order to provide the ideal amount of linear compensation for each of said strings.

16. The method of claim 14, wherein each said string positioning mechanism includes:

a first v-shaped string guidance channel located at a front face of said combination intonated string nut and string locking mechanism; and a second v-shaped string guidance channel located at a rear face of said combination intonated string nut and string locking mechanism.

17. A method of using a stringed musical instrument having a combination intonated string nut and string-locking mechanism, said combination intonated string nut and string-locking mechanism comprising:

a string-nut fulcrum for each individual string, wherein each said string nut fulcrum has a varying linear position in relation to each said individual string in order to optimize the compensation amount for the musical notes produced for each said individual string, when each said individual string is caused to vibrate between a bridge fulcrum and said string nut fulcrum, and whereby as a result of said optimum compensation, the musical notes produced will be in tune relative to each other when each said individual string is caused to vibrate between said bridge fulcrum and either said string-nut fulcrum or any one of a plurality of fret fulcrums (for fretted stringed musical instruments); and a string-locking means, wherein said string-locking means provides a rigid linear position securability of each of said individual strings at each of said string-nut fulcrums by means of compressing each of said strings between a first rigid surface with a fixed position and a second rigid surface that is height adjustable and position lockable;

the method comprising the steps of:

ensuring that said combination intonated string nut and string-locking mechanism is installed on the neck of a target stringed and fretted musical instrument;

ensuring that each string of said musical instrument is suspended at one end at the upper neck of said musical instrument by its associated string-nut fulcrum, which has been positioned at a predetermined depth in order to provide the ideal amount of linear compensation for the associated string;

as necessary, adjusting each string tension by its associated tuner on the headstock of said musical instrument;

ensuring that each string is locked into a rigid linear position by said string-locking means; and playing said musical instrument by causing at least one string on said musical instrument to vibrate.

18. The method of claim 17, wherein said target stringed musical instrument has a vibrato mechanism, the method further comprising the step of:

employing said vibrato mechanism to cause periodic variances in the pitch of one or more vibrating strings.

19. The method of claim 17, wherein said combination intonated string nut and string-locking mechanism includes a string-positioning mechanism for each of said strings.

20. The method of claim 17, wherein said target stringed musical instrument is selected from the group consisting of violin, viola, cello, double bass, hammer dulcimer, and clavichord.

* * * * *